US012774810B2

(12) United States Patent
Tertilt et al.

(10) Patent No.: US 12,774,810 B2
(45) Date of Patent: Oct. 27, 2026

(54) HYDROGEN-FIRED COMBUSTION CHAMBER SYSTEM, METHOD AND PLANT

(71) Applicant: Siemens Energy Global GmbH & Co. KG, Bayern (DE)

(72) Inventors: Marc Tertilt, Hattingen (DE); Friederike Lange, Langenfeld (DE); Martin Stapper, Kamp-Lintfort (DE); Marcus Gwenner, Gladbeck (DE); Christoph Kortschik, Düsseldorf (DE); Norbert Sürken, Mülheim a.d. Ruhr (DE); Leonard Muke, Mülheim an der Ruhr (DE)

(73) Assignee: Siemens Energy Global GmbH & Co. KG, Munich (DE)

( * ) Notice: Subject to any disclaimer, the term of this patent is extended or adjusted under 35 U.S.C. 154(b) by 399 days.

(21) Appl. No.: 18/574,110

(22) PCT Filed: Jun. 2, 2022

(86) PCT No.: PCT/EP2022/065112
§ 371 (c)(1),
(2) Date: Dec. 26, 2023

(87) PCT Pub. No.: WO2023/274661
PCT Pub. Date: Jan. 5, 2023

(65) Prior Publication Data

US 2024/0318818 A1 Sep. 26, 2024

(30) Foreign Application Priority Data

Jul. 1, 2021 (EP) ..... 21183260

(51) Int. Cl.
*F23L 7/00* (2006.01)
*F01K 21/04* (2006.01)
(Continued)

(52) U.S. Cl.
CPC ..... *F23L 7/005* (2013.01); *F01K 21/04* (2013.01); *F01K 25/005* (2013.01); *F22B 1/003* (2013.01);
(Continued)

(58) Field of Classification Search
CPC . F23L 7/005; F23L 7/007; F23L 2900/07005; F23L 2900/07009;
(Continued)

(56) References Cited

U.S. PATENT DOCUMENTS 5,088,450 A 2/1992 Sternfeld
6,201,029 B1 * 3/2001 Waycuilis ..... C01B 3/382 518/703
(Continued)

FOREIGN PATENT DOCUMENTS

CN 114207356 A * 3/2022 ..... F23R 7/00
DE 20313279 U1 10/2003
(Continued)

OTHER PUBLICATIONS

JP_2006017367_A translation (Year: 2026).*
(Continued)

*Primary Examiner* — Michael G Hoang
*Assistant Examiner* — Kurt J Wolford
(74) *Attorney, Agent, or Firm* — Wolter Van Dyke Davis, PLLC

(57) ABSTRACT

A combustion chamber ("steam booster") system for burning hydrogen with the aim of heating a flow of steam and/or of increasing the steam states of the hydrogen, and a method and a plant. In the combustion chamber system, hydrogen and preferably oxygen can be burned in the presence of water and/or water vapor in a combustion chamber, steam can flow around the combustion chamber on the outside in an intermediate space, in particular can flow over the entire length of the combustion chamber in the intermediate space of a flame tube.

18 Claims, 13 Drawing Sheets

(51) Int. Cl.

| | |
|---|---|
| ***F01K 25/00*** | (2006.01) |
| ***F22B 1/00*** | (2006.01) |
| ***F22B 1/26*** | (2006.01) |
| ***F22G 1/12*** | (2006.01) |
| ***F23R 3/06*** | (2006.01) |
| ***F23R 3/44*** | (2006.01) |

(52) U.S. Cl.
CPC ..... *F22B 1/26* (2013.01); *F22G 1/12* (2013.01); *F23R 3/06* (2013.01); *F23R 3/44* (2013.01); *F23C 2900/9901* (2013.01); *F23L 7/007* (2013.01); *F23L 2900/07005* (2013.01); *F23L 2900/07009* (2013.01)

(58) Field of Classification Search
CPC ..... F01K 21/04; F01K 25/005; F22B 1/003; F22B 1/26; F22G 1/12; F23R 3/06; F23R 3/44; F23C 2900/9901
See application file for complete search history.

(56) References Cited

U.S. PATENT DOCUMENTS

| | | | | |
|---|---|---|---|---|
| 7,770,646 | B2 * | 8/2010 | Klassen | E21B 43/243 166/303 |
| 2006/0021322 | A1 | 2/2006 | Haberberger | |
| 2006/0266040 | A1 | 11/2006 | Haberberger | |
| 2007/0190469 | A1 * | 8/2007 | Clark | B01D 53/8659 431/5 |
| 2017/0342860 | A1 | 11/2017 | Morisawa | |
| 2019/0017696 | A1 * | 1/2019 | Bool | F23L 7/00 |
| 2020/0072458 | A1 | 3/2020 | Partheepan | |

FOREIGN PATENT DOCUMENTS

| | | | | |
|---|---|---|---|---|
| DE | 102013223661 | B4 | 5/2015 | |
| EP | 0427033 | B1 | 12/1994 | |
| EP | 1375827 | A1 | 1/2004 | |
| EP | 3214367 | B1 | 7/2020 | |
| JP | H10213308 | A | 8/1998 | |
| JP | 3017937 | B2 | 3/2000 | |
| JP | 2006017367 | A | 1/2006 | |
| JP | 2020024068 | A | 2/2020 | |
| KR | 101123114 | B1 * | 3/2012 | H01M 8/0618 |
| WO | 2017158636 | A1 | 9/2017 | |

OTHER PUBLICATIONS

KR-101123114-B1 translation (Year: 2026).*
CN-114207356-A translation (Year: 2026).*
Dunfield_Timber_shiplap_vs._v-groove_2020.pdf (Year: 2020).*
PCT International Search Report and Written Opinion of International Searching Authority mailed Sep. 16, 2022 corresponding to PCT International Application No. PCT/EP2022/065112 filed Jun. 2, 2022.

* cited by examiner

HYDROGEN-FIRED COMBUSTION CHAMBER SYSTEM, METHOD AND PLANT

CROSS REFERENCE TO RELATED APPLICATIONS

This application is the US National Stage of International Application No. PCT/EP2022/065112 filed 2 Jun. 2022, and claims the benefit thereof, which is incorporated by reference herein in its entirety. The International Application claims the benefit of European Application No. EP21183260 filed 1 Jul. 2021.

FIELD OF INVENTION

The invention describes a combustion chamber system ("steam booster") for burning hydrogen with the aim of heating a flow of steam and/or of increasing the steam states of the hydrogen, and a method and a plant.

BACKGROUND OF INVENTION

Frequently, a steam circuit is not internally fired, but rather the boiler in the power plant is generally fired externally with, for example, coal, nuclear waste heat or via the exhaust gas of a gas turbine which is fired with gas or oil.

Such a steam power plant is described in EP 1 375 827 A1.

The aim is to use hydrogen.

SUMMARY OF INVENTION

The object is achieved by a combustion chamber system and by a method and a plant as claimed.

Further advantageous measures which may be combined as desired with one another to obtain further advantages are listed in the dependent claims.

It is proposed to present a combustion chamber system having hydrogen firing, a method and a plant for this purpose.

The advantage is the combustion of pure hydrogen ($H_2$) and preferably oxygen ($O_2$) with water steam as a combustion product.

The aim is turbines operated without pollutants and with water or water vapor as a combustion product ($CO_2$-free, $NO_x$-free) or for generating process steam.

The combustion chamber system can particularly also be integrated in an existing steam power plant or in a steam gas turbine plant (GuD).

In addition, the combustion chamber system can be integrated in industrial applications with steam circuits or steam extractions, in which in particular $CO_2$-free additional firing is required.

BRIEF DESCRIPTION OF THE DRAWINGS

In the figures

DETAILED DESCRIPTION OF INVENTION

Figure 1:
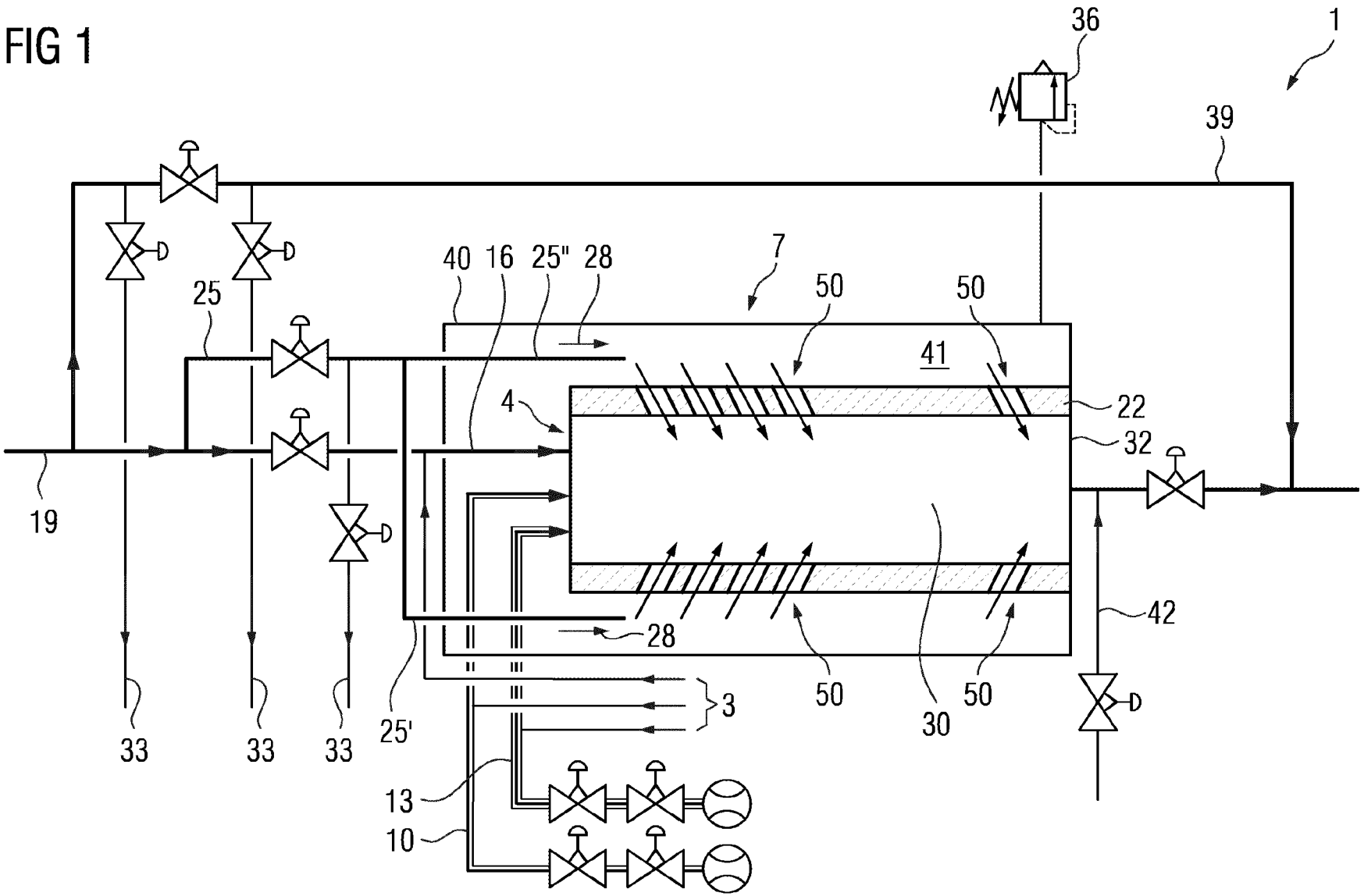
FIG. 1 shows schematically the basic principle of a combustion chamber system.

FIG. 1 shows a combustion chamber system 1 according to the invention.

The combustion chamber system 1 has, as central part, a combustion cylinder 7 with a combustion chamber 30.

The combustion chamber 30 has a baseplate 4 which is preferably directly adjoined by a flame tube 22 with the combustion chamber 30 and an outlet opening 32 at the end of the combustion chamber 30.

The flame tube 22 is preferably ceramic, particularly completely ceramic.

The length of the combustion chamber 30 or of the flame tube 22 is preferably at least three times, in particular three to five times, the length of the hydraulic diameter of the combustion chamber 30.

The cross section of the combustion chamber 30, as seen in the combustion chamber direction 31, can be circular or oval-shaped.

Preferably, in the baseplate 4 there are a plurality of lines (also see FIGS. 6 and 7) which supply the fuel, hydrogen and preferably oxygen and also steam, in particular water vapor. However, air can preferably also be used instead of oxygen ($O_2$).

The lines are in particular at least a first supply line 10 for the oxygen ($O_2$), a second supply line 13 for the hydrogen ($H_2$), and a third supply line 16 for the water vapor ($H_2O$). There are preferably only these supply lines 10, 13, 16. However, other, fewer or more supply lines are also possible.

Water vapor is preferably supplied to the combustion chamber system 1 via a central steam line 19 which in particular is divided, particularly into the third supply line 16 for the steam for the combustion chamber 30 and preferably into a steam line 25 for the steam which flows in an intermediate space 41 around the flame tube 22 and then flows in places via steam passages 50 or steam outlets 150 (FIGS. 10 and 15) through the flame tube 22 into the combustion chamber 30.

The intermediate space 41 is preferably directly bounded by the flame tube 22 and a pressure jacket 40.

The steam passages 50 and/or steam outlets 150 are preferably distributed over the entire length of the flame tube 22 and preferably also around the circumference of the flame tube 22.

Steam flows around the flame tube 22 preferably over the entire length thereof.

The steam line 25 can be divided in particular into two steam lines 25', 25" for the intermediate space 41.

The intermediate space 41 is closed at the end, in particular in the region of an outlet opening 32. In particular, the intermediate space 41 is a sealed space, i.e. except for the supply lines, in particular for the steam, and the steam passages 50 and steam outlets 150. All of the steam thus flows from the supply lines preferably out of the intermediate space 41 completely into the combustion chamber 30.

The combustion chamber system 1 furthermore preferably has drainage lines 33, pressure control valves or overpressure protection 36 for it, and a steam bypass 39.

Similarly, an $H_2O$ spray 42 can preferably be present at the end of the combustion cylinder 7.

In addition, there is preferably a flushing system 3 which can flush the supply lines through; in particular, nitrogen is used here.

It is also advantageous that the flame tube 22 can be cooled during operation by the steam 28 flowing around it and/or can preferably be preheated by the water vapor in the stand-by mode.

Figure 2:
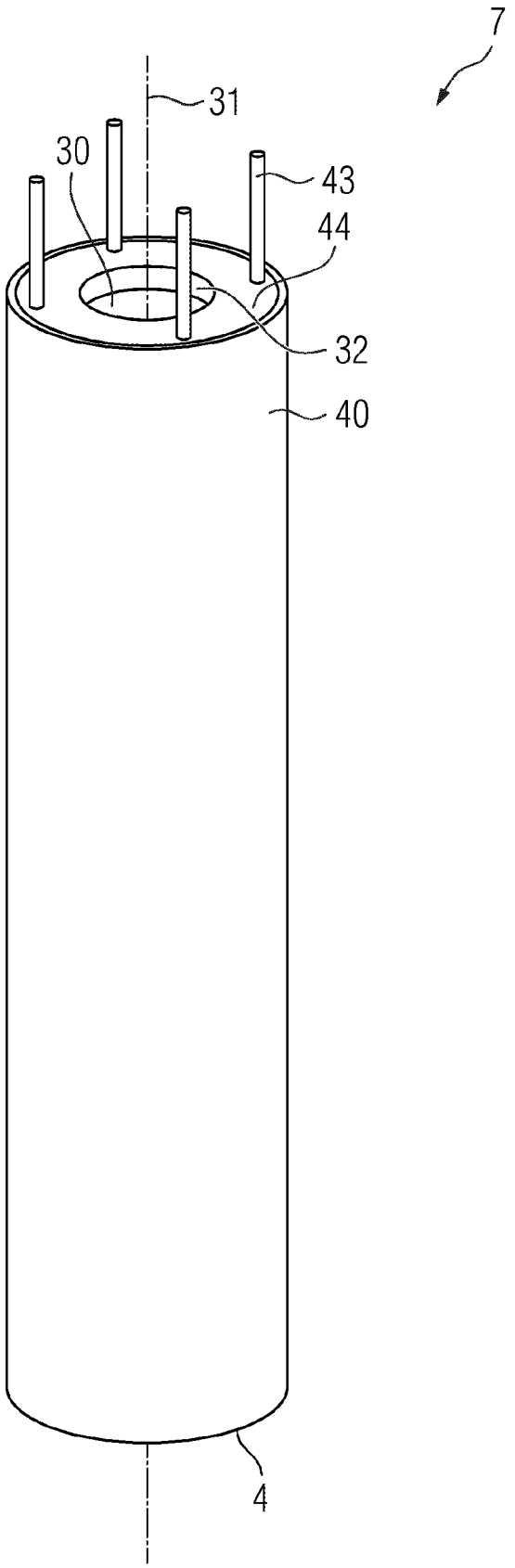
FIG. 2 shows a top view of a combustion cylinder.

The proposed combustion chamber system 1 preferably has a combustion chamber axis 31, as is illustrated in FIG. 2. It is preferably also an axis of symmetry of the flame tube 22 and/or the combustion chamber 30.

Figure 3:
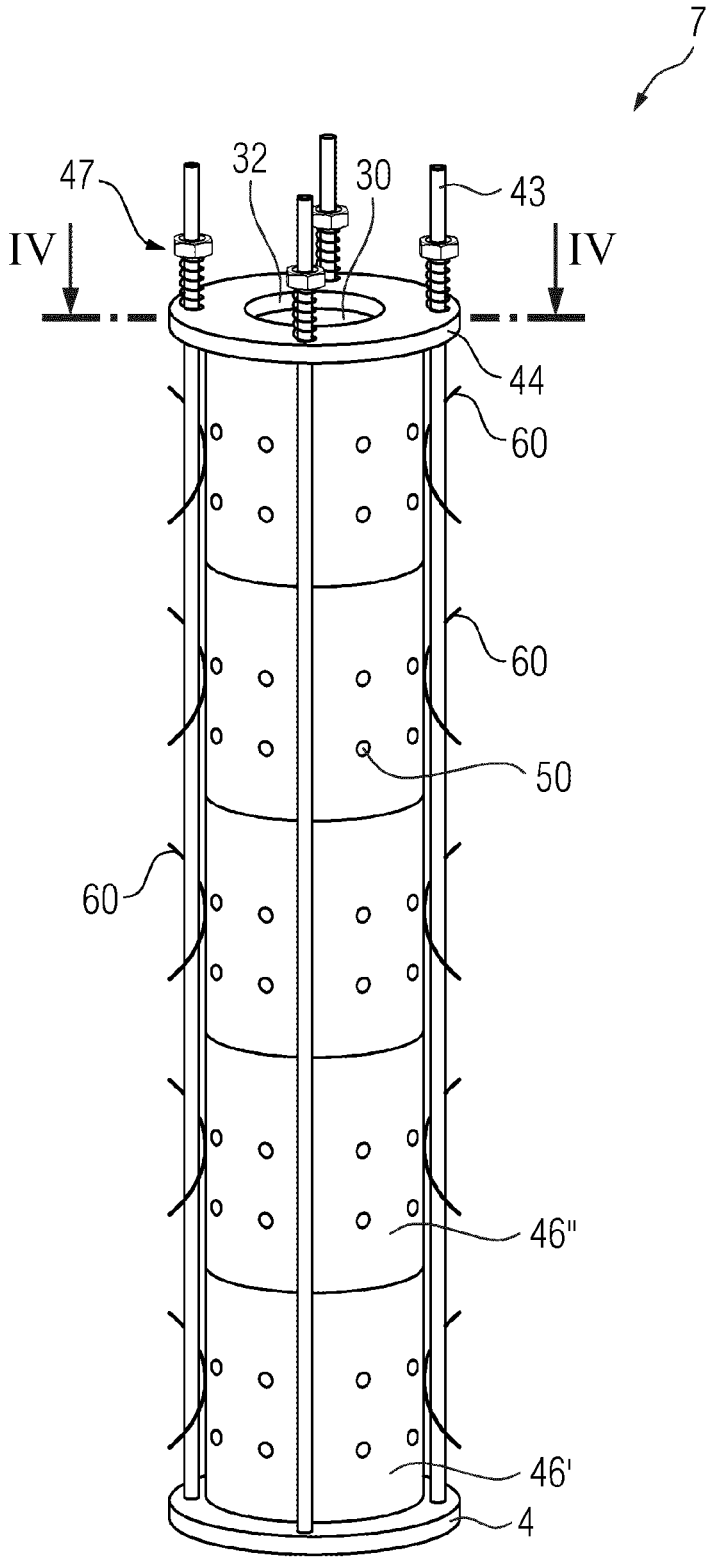
FIG. 3 shows a combustion cylinder without an external pressure jacket.

The combustion chamber 7 can also be arranged horizontally with corresponding supports (optionally leaf springs 60 in FIG. 3).

The combustion chamber 30 preferably has the same cross section transversely with respect to the combustion chamber axis 31 over the length and preferably over the entire length.

The use and the variation options of the proposed combustion chamber system 1 are universal.

The combustion chamber system 1 preferably operates in a steam atmosphere preferably of 1 bar to 140 bar, particularly 1 bar to 80 bar. The combustion chamber 30 is operated in a steam atmosphere of preferably at least 2 bar, particularly at least 6 bar.

A pressure loss of 100 mbar-3000 mbar is preferably set.

FIG. 2 shows the combustion cylinder 7 with the external pressure jacket 40 around the flame tube 22 (therefore not visible), as a result of which the intermediate space 41 (FIG. 4) is formed.

According to FIG. 3, individual or a plurality of modules 46', 46", . . . form the flame tube 22.

The modules 46', 46", . . . are then preferably also ceramic.

However, a monolithic flame tube 22 made from ceramic or metal can also be used.

Use is preferably made of an oxide ceramic, particularly on the basis of aluminum oxide or aluminum oxide/spinel. Preferably, no CMC is used.

Similarly, preferably no SiC or no silicon-based ceramic is used.

The modules 46', 46", . . . are preferably ceramic, but may also be formed with metallic tubes, e.g., of Ni-based alloys, e.g. Inconel, with ceramic coatings, as is known from coating systems of gas turbine blades or metallic heat shield elements of gas turbines.

For the formation of the flame tube 22 of the combustion chamber system 1, the modules 46', 46", . . . are particularly arranged one above another and particularly coaxially with respect to one another and one above another.

The flame tube 22 or the modules 46', 46", . . . are particularly annular and preferably circular or oval-shaped in cross section.

A plurality of preferably rods 43, particularly threaded rods, which guide and hold together the individual modules 46', 46", . . . (FIGS. 3, 4, 5, 10 and 11) or the flame tube 22 can be seen in FIGS. 2 and 3.

Similarly, other options for the mechanical assembly or mechanical holding together are conceivable.

For example, there are five modules 46', 46", . . . here which are held together by the rods 43 and by an upper plate 44 and the baseplate 4.

The intermediate space 41 can thus be formed around the flame tube 22 by means of the external pressure jacket 40.

In particular, the modules 46', 46", . . . and the baseplate 4 are held together with fastening elements 47, in particular consisting of spring elements and screws, around the rods 43 which lie against the upper plate 44. Other fastening methods and elements are possible.

Also illustrated in FIG. 3 are preferably used leaf spring elements 60 which support the modules 46', 46", . . . against the external pressure jacket 40 (not depicted).

Figure 4:
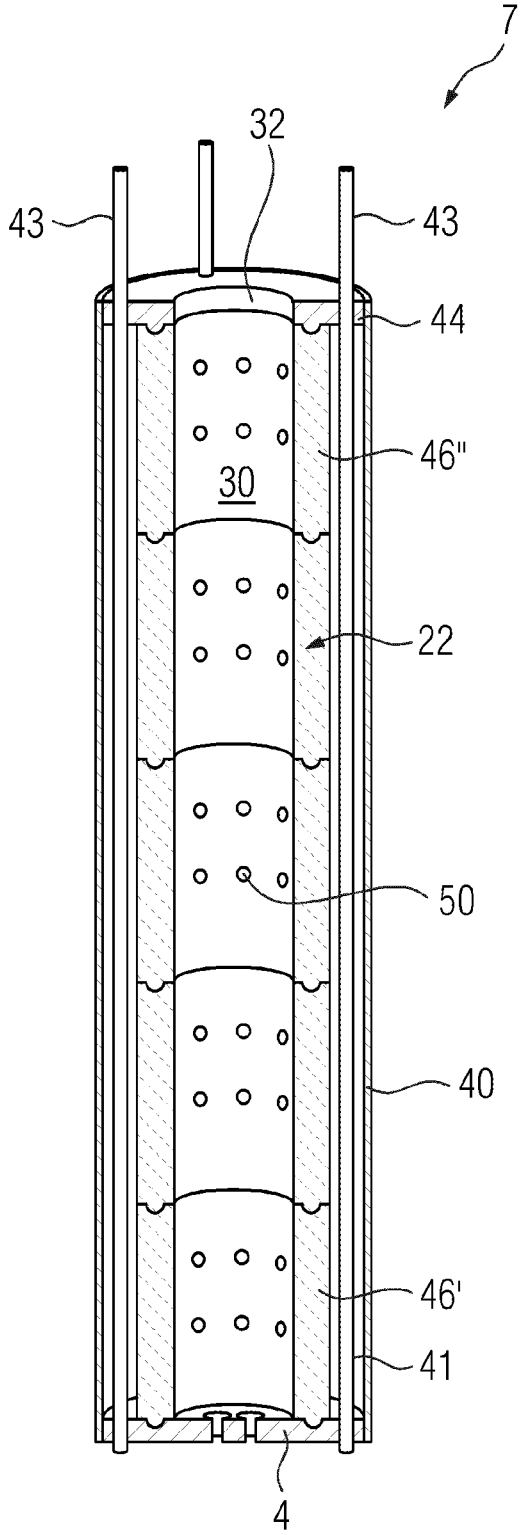
FIG. 4 shows a section through FIG. 2, FIGS. 5-7 show detailed views of a base of a combustion chamber.

A section through FIG. 3 is shown in FIG. 4 which shows the flame tube 22 or the modules 46', 46", . . . with the combustion chamber 30 and steam passages 50.

The steam passages 50 are through holes in a module 46 or in the flame tube 22.

The steam passages 50 are preferably distributed uniformly in the flame tube 22 or in a module 46', 46", . . . or particularly may also be distributed asymmetrically, depending on the heat load.

Figure 9:
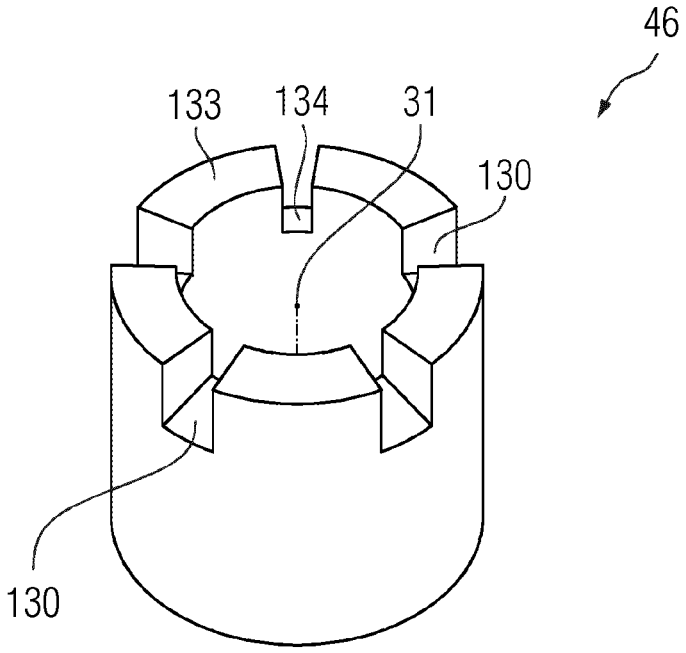
FIGS. 9, 14 show a module for a flame tube.
Figure 10:
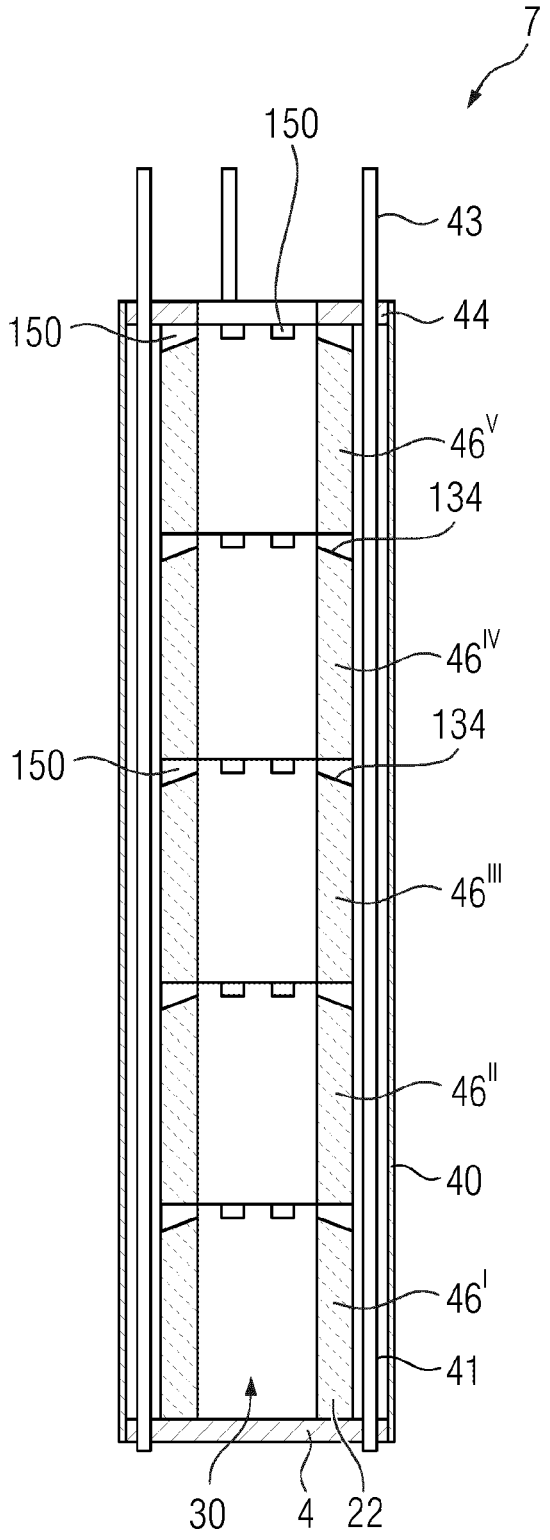
FIGS. 10, 15 show a stacking and arrangement of modules.

Along the length of the flame tube 22, the modules 46", 46", . . . or a monolithic flame tube 22 may be configured differently and variously corresponding to the technical requirements and may have more or fewer steam passages 50 or steam outlets 150 (FIGS. 9 and 10).

The outlet opening 32 is preferably realized above the upper plate 44 which firstly ensures the mutual centering of the modules 46', 46", . . . or of the flame tube 22 and particularly at the same time contains a shadow in order to prevent the overheating of the following components by the radiant heat of the flame tube 22.

Figure 13:
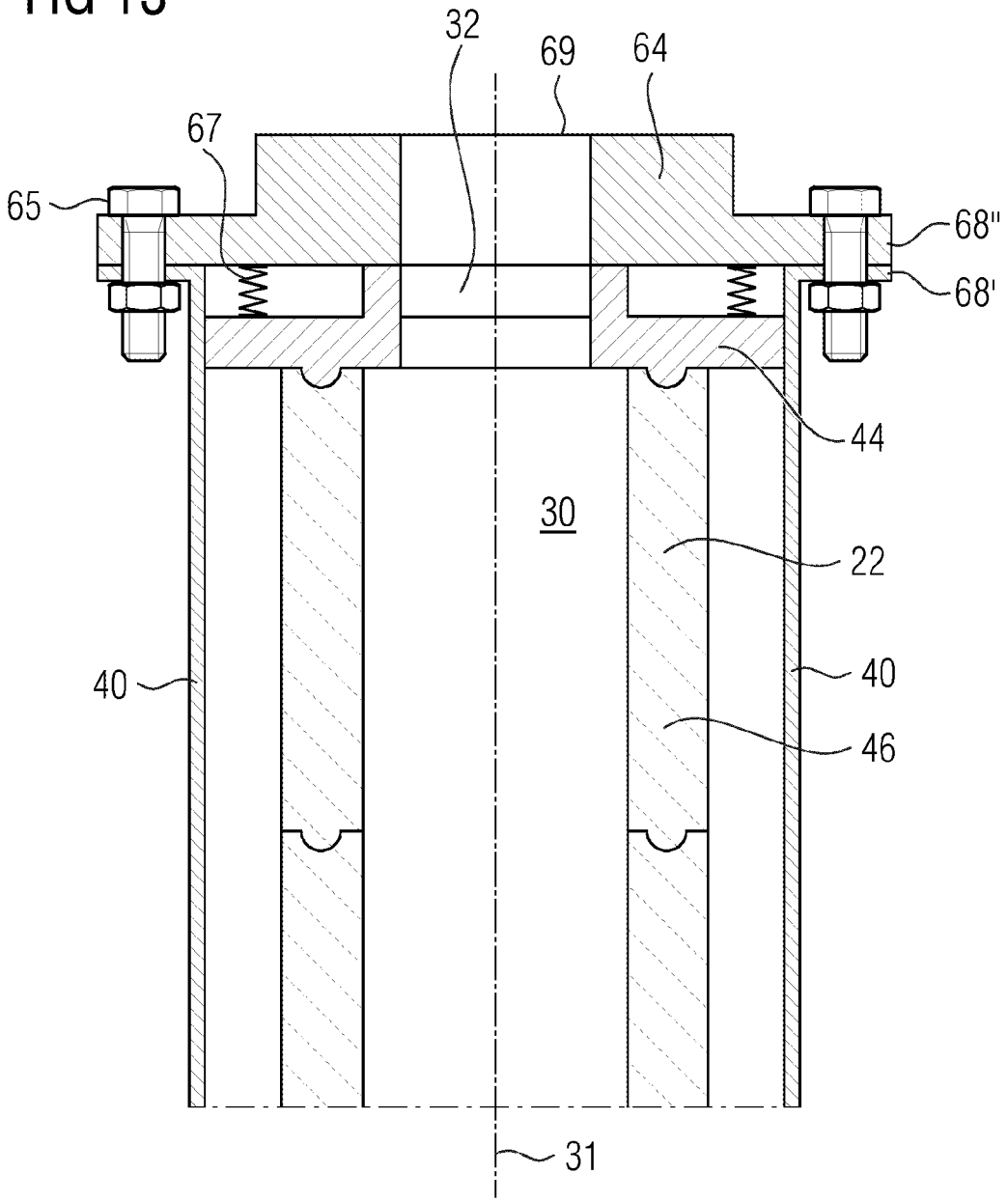
FIG. 13 shows an outlet region of the combustion chamber, FIG. 16, 17 show top views of a module.

FIG. 13 illustrates a modification of the end of the combustion cylinder 7.

The external pressure jacket 40 has a flange 68' on which a cover plate 64 rests and is screwed by its flange 68" to the flange 68' of the external pressure jacket 40 by means of a fastening element 65, in particular a screw and nut.

The modules 46', . . . or the flame tube 22 are/is held together or pressed together by tongue elements 67 preferably present between the cover plate 64 and upper plate 44. The cover plate 64 accordingly has an outlet opening 69 which lies opposite or extends the outlet opening 32.

The baseplate 4 (or flame tube base) (FIG. 5) comprises a burner and the ignition unit (neither illustrated) and serves as a means of centering the modules 46', 46", . . . or the flame tube 22.

In the case of the modular design, the combustion chamber 30 is formed in particular by stacking in particular modules 46', 46", . . . which, particularly by means of a tongue and groove geometry, center themselves on the contact surfaces, and provide sealing and support.

Fastening means, particularly a tongue 101 and groove 102 structure, particularly hemispherical here for example, do not obstruct a thermal expansion of the individual, in particular ceramic modules 46', 46", . . . , and also with the baseplate 4 during heating and cooling. This avoids thermally induced stresses.

The tongue 101 and groove 102 structure can preferably also be formed between the modules 46', 46", . . . and/or between a module 46' and baseplate 4 and/or between a module 46 and upper plate 44.

The combustion chamber 30 can be varied in length as desired by the stacking of different numbers of modules 46', 46", . . . .

In particular, modules 46', 46", . . . differing in length can be used.

The combustion chamber 30 may also be varied in diameter by the modules 46', 46", . . . varying in diameter. A conicity with the modules 46', 46" is also possible.

The individual modules 46', 46", . . . are preferably either guided in a tube or by/on rails or prestressed by rods 43.

The prestressing is undertaken via the rods 43 and spring elements with a contact pressure suitable for ceramic. The ceramic is exclusively subjected to a compressive stress.

Each module 46', 46", . . . or the flame tube 22 preferably contains defined steam passages 50 which permit the mixing zone of the combustion and the surrounding steam to mix gradually in order to ensure optimum combustion of hydrogen ($H_2$) and preferably oxygen ($O_2$) and to set the required or desired temperatures.

The steam passages 50 are round and/or oval and/or angular and also constant or variable in cross section in their flow direction and are arranged in particular at shallow angles, particularly between 80° and <90°, in the flow direction in order to prevent application of the hot flame to the wall of the flame tube 22 and/or to introduce turbulence into the combustion media.

If required, they can also be directed in such a way that they open directly into a flame and induce vigorous mixing.

In principle, the steam passages 50 can be distributed in various sizes over the length of the modules 46 or over the length of the flame tube 22 or can be designed as steam outlets 150 on the end face 133 of a module 46. Combinations of the two principles are also possible.

The arrangement can be selected specifically for the different industrial applications, applications for generating power or using hydrogen ($H_2$) and preferably oxygen ($O_2$) in steam-conducted combustion processes.

Figure 5:
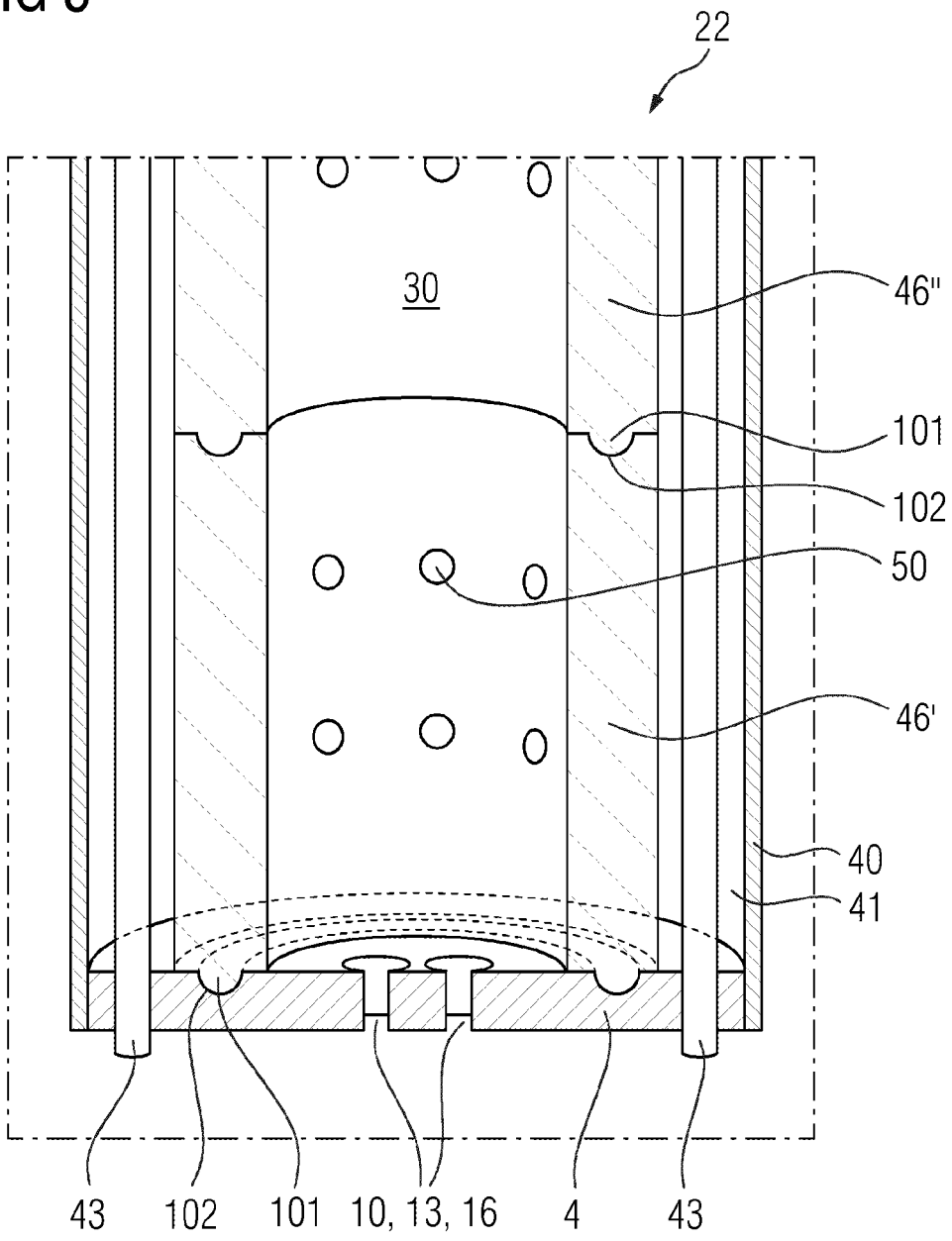

Examples of the arrangement of the steam passages 50 can be gathered from FIGS. 3, 4 and 5.

FIG. 4 also discloses that the combustion chamber 30 over the length preferably has the same cross section transversely with respect to the combustion chamber axis 31.

Figure 6:
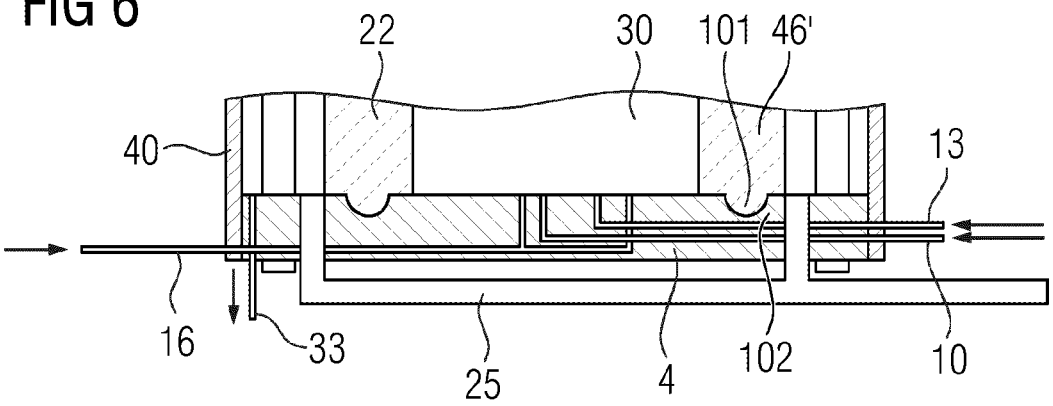

According to FIG. 6, the baseplate 4 takes on a plurality of functions:

- the mechanical clamping of the flame tube 22 or of the modules 46', 46", . . . , particularly by means of the tongue and groove principle
- the supply lines 10, 13 of the combustion media and
- the supply line 16 of the water vapor into the combustion chamber 30, and
- in a special variant, also the mixing of hydrogen ($H_2$), preferably oxygen ($O_2$) and injected water or water vapor upstream of a burner 58 (FIG. 7)
- and the supply by means of steam line 25 of injected water or water vapor into the intermediate space 41 having the surrounding external pressure jacket 40; as a result, the flame tube 22 is cooled and preferably no further cooling is required.

By means of preferably 3D manufacturing of the baseplate 4, particularly by means of SLM, these functions can be ideally combined with one another.

The fuel is preferably mixed here only in the combustion chamber 30.

FIG. 6 also shows that steam flows into the region between flame tube 22 and external pressure jacket 40.

The steam preferably flows in the direction of the outlet opening 32.

Steam is also supplied to a burner 58 and/or around the burner 58.

Figure 7:
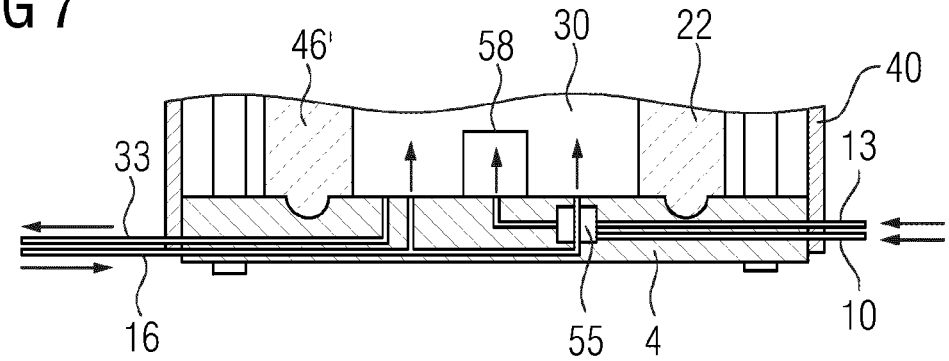

FIG. 7 shows a variant of the baseplate 4 with internal pre-mixing in a mixer 55 in the baseplate 4, wherein the arrangement of the injection planes in the steam through-passage can be configured individually. A repetition of said passages can also be easily permitted.

FIG. 7 shows, in the cross section of the baseplate 4, the mixing (HHO) of hydrogen ($H_2$) and oxygen ($O_2$) and optionally water or water vapor ($H_2O$) within the baseplate 4 of the combustion chamber system 1.

In this variant, hydrogen ($H_2$) and oxygen ($O_2$) are mixed in the mixer 55 and only then supplied to the combustion chamber 30.

Figure 8:
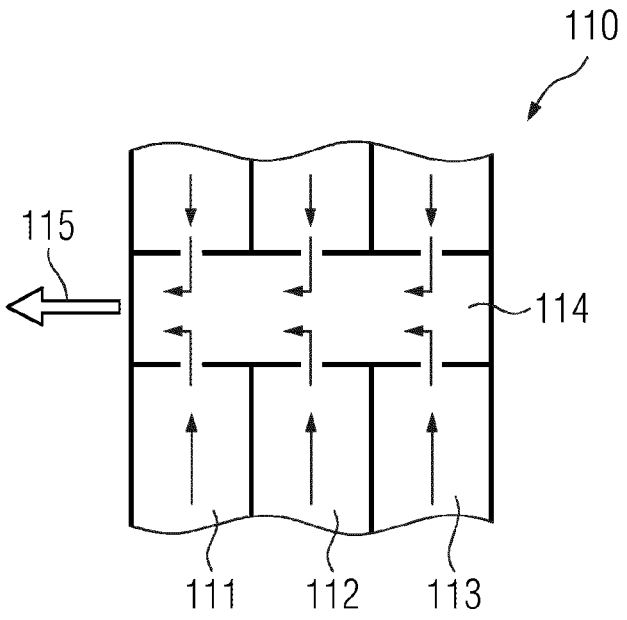
FIG. 8 shows a mixing system.

FIG. 8 shows in schematically illustrated form how various media can be mixed with one another preferably in a plate 110, such as the baseplate 4.

In this case, it is the hydrogen 111, the oxygen 112 and the steam 113 which each flow laterally into a channel 114 and are therefore mixed there.

The mixture then exits from the channel 114 in a direction 115, for example, into the combustion chamber 30 according to FIG. 6 or 7.

FIG. 9 shows an individual module 46.

A plurality of depressions 130 are preferably present starting from the upper end face 133 of the module 46.

The shape of the depressions 130 may be diverse, for example may have a narrowing, wedge-shaped profile in the plane of the base surface 134 of the depression 130.

Figure 14:
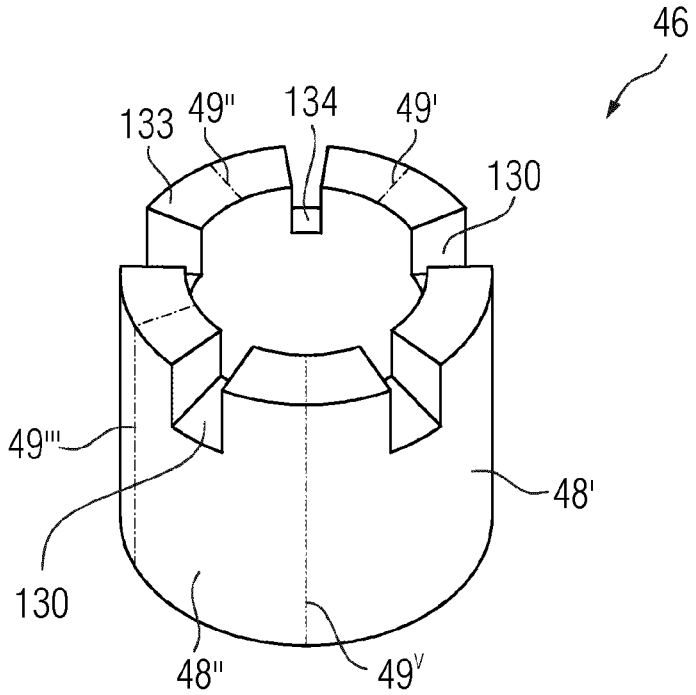
Figure 15:
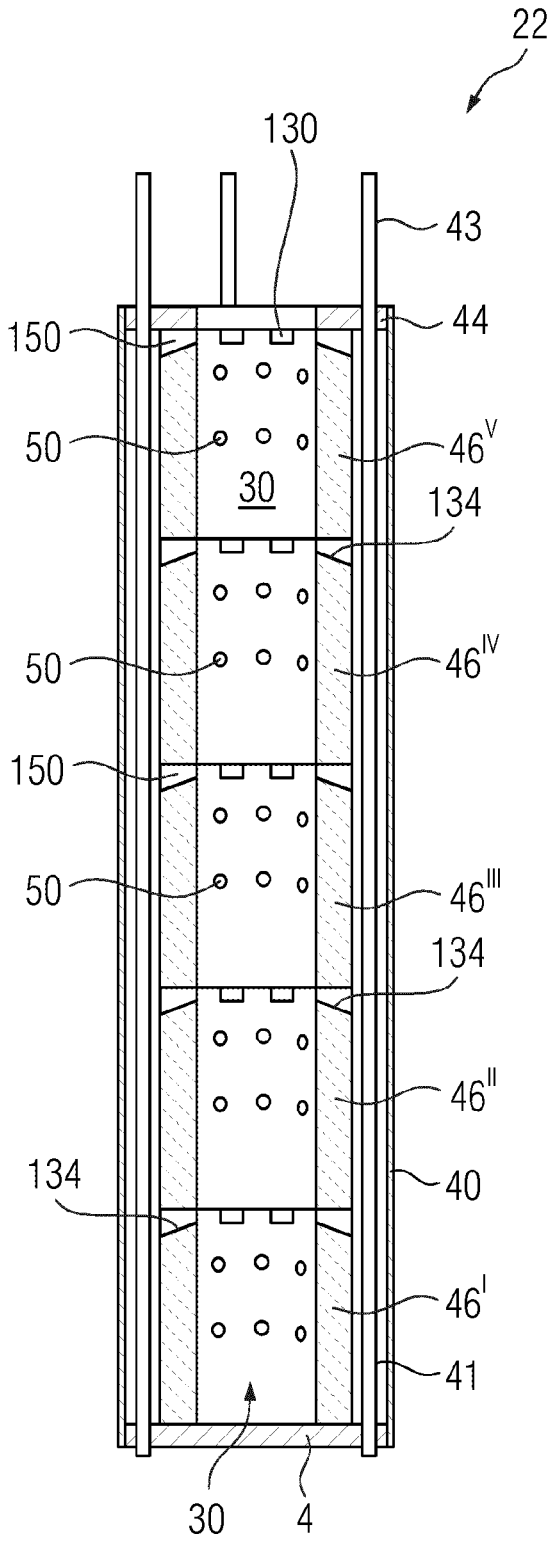

The base surface 134 of a depression 130 is preferably flat, i.e. the combustion chamber axis 31 (or a parallel thereto) is perpendicular to the base surface 134 (FIGS. 9 and 14) or the base surface 134 has a rising or falling profile, i.e. the combustion chamber axis 31 (or a parallel thereto) is not perpendicular to the base surface 134, as can be seen in FIGS. 10 and 15 for a number of steam outlets 150 in the cross section of the modules 46.

The geometry and arrangement of the steam outlets 150 may be different for each individual module 46 or identical for the modules 46', 46", . . . in question.

The geometry and arrangement of the steam outlets 150 may also be different in particular for an individual module 46.

Figure 16:
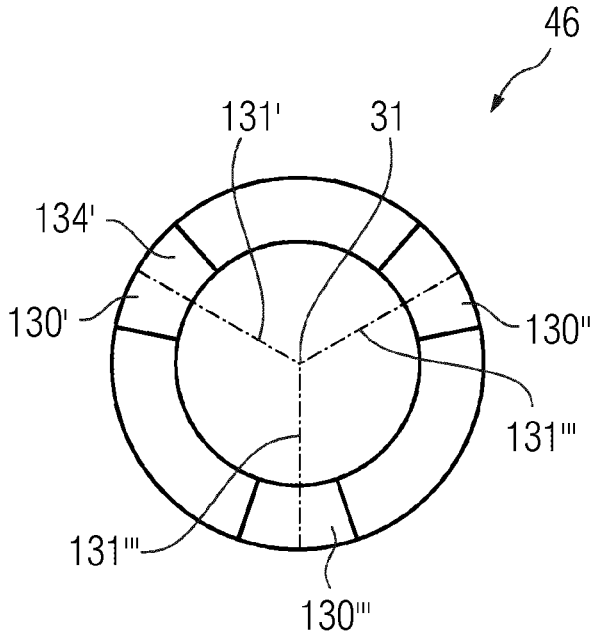

FIG. 16 shows a top view of a module 46' according to FIG. 9 (or FIG. 14).

Each depression 130', 130", 130'", . . . has a center line 131', 131", 131". The center line 131', . . . divides the base surface 134 in half.

The center lines 131', 131", . . . of the depressions 130', 130", . . . preferably meet in the center of the module 46, i.e. at the point of the combustion chamber axis 31.

The base surface 134 here is preferably wedge-shaped (frustospherical) since the edges of the base surface 134 are radials.

Figure 17:
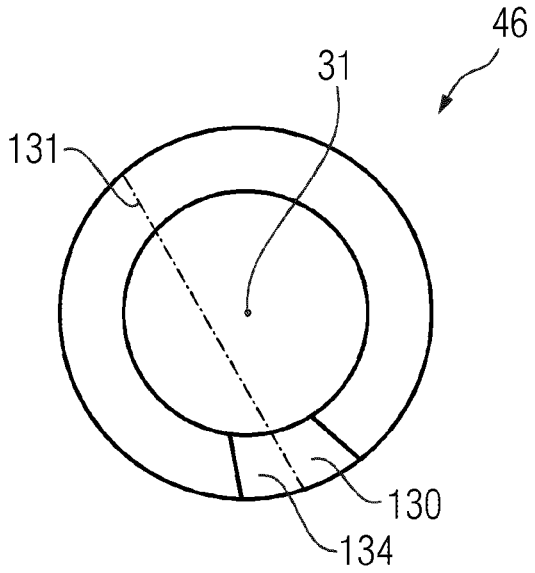

Similarly, the depression 130 with its center line 131 can be configured in such a way that the center line 131 of the base surface 134 does not run through the combustion chamber axis 31, as is indicated by way of example in FIG. 17 for a depression 130. This permits tangential turbulence when a fluid, here steam, flows through the steam outlet. The base surface 134 is therefore preferably not wedge-shaped here.

The base surface 134 can preferably also be square or rectangular.

The module 46 can also in turn consist of a plurality of elements 48', 48", . . . . Such an element 48', 48", . . . of a module 46 is illustrated in FIG. 14 by the dashed separating lines 49', . . . .

Each module 46 (FIG. 9) or element 48', . . . (FIG. 14) for a module 46 according to FIGS. 9, 14, 16, 17 can have steam passages 50 which are already through holes per se.

Steam outlets 150 having the same purpose as the steam passages 50 are produced only by stacking of the individual modules 46', . . . .

The meaning of the depressions 130 becomes clear in FIG. 10 because through holes for the flame tube 22, i.e. steam outlets 150, are produced from the depressions 130 by the stacking of a plurality of modules 46' to 46".

These steam outlets 150 can also preferably be freely selected and configured in their geometry.

Such a steam outlet 150 can also be completely produced only by the stacking of two modules 46', 46", . . . lying directly on one another, particularly if the end faces 133 each have a semicircular depression which, when stacked together one above another, produce a circular cross section.

Steam outlets 150 owing to the depressions 130 and steam passages 50 can also be present simultaneously (FIG. 15).

Figure 11:
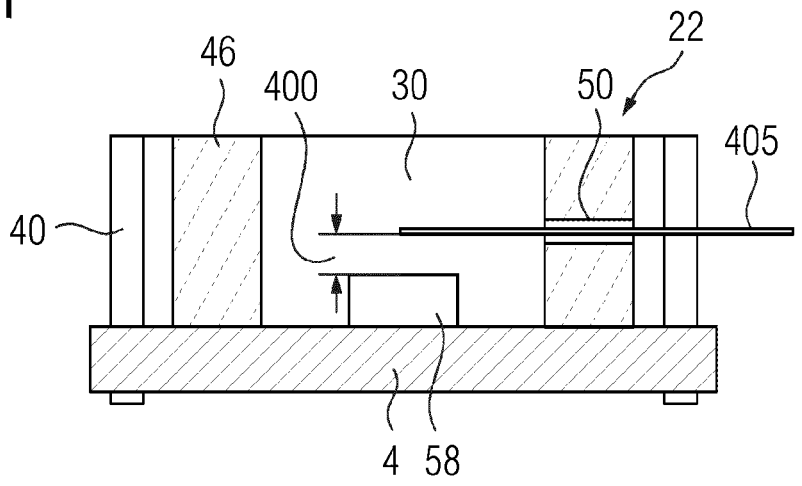
FIG. 11 shows an ignition arrangement.

A burner 58 is arranged on the base in the combustion chamber 30 (FIG. 11).

This burner 58 is preferably a porous burner.

For an igniter 405, a design is possible in which the igniter 405 is introduced laterally into the combustion chamber 30 (FIG. 11).

FIG. 11 schematically illustrates how the arrangement of igniter 405 and burner 58 is configured.

By means of a steam passage 50 or another feedthrough, the igniter 405 is supplied transversely with respect to the longitudinal direction above the burner 58 or is present there.

The igniter 405 can preferably be supplied to the combustion chamber such that, during operation, after ignition for the first and only time, the igniter 405 can be removed from the highly corrosive region.

The igniter 405 is at a corresponding distance 400 from the burner, as seen in the longitudinal direction of the combustion chamber 30. The ignition takes place between burner 58 and ignition device 405.

After the ignition, i.e. in the booster mode, the igniter 405 can be removed from the combustion chamber 30.

Figure 12:
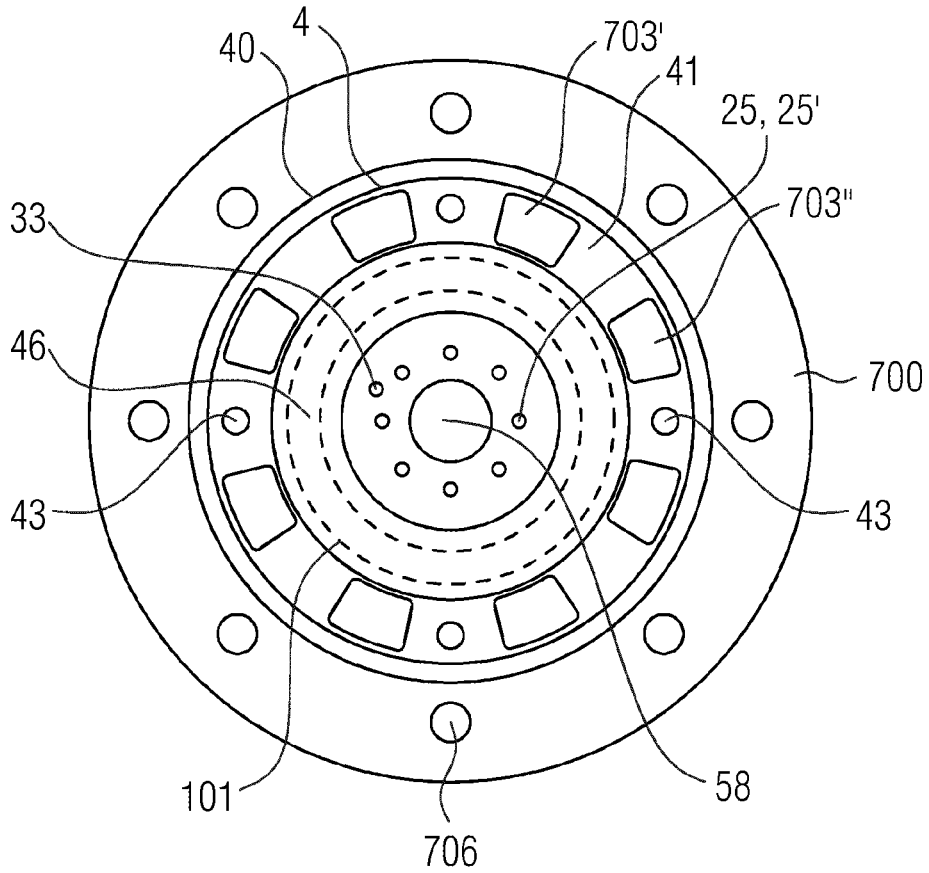
FIG. 12 shows a top view of a flange.

FIG. 12 shows the top view of a flange 700 with a baseplate 4 with steam inlet openings, drainage openings for drainage lines 33 for removing condensates from the booster, and the opening for the burner 58.

Steam is supplied to the combustion chamber system 1 from the steam of the existing plant through openings 703', 703". These are preferably a plurality of openings which are distributed in particular uniformly around the circumference.

The rods 43 which are also preferably distributed uniformly around the circumference are arranged schematically between the openings 703', . . . .

The steam therefore flows here into the intermediate space 41 between the external pressure jacket 40 and flame tube 22.

The drainage openings for drainage lines 33 can also be seen.

The burner 58 around which the steam lines 25', 25", . . . are arranged is arranged centrally.

The profile of the modules 46 is also illustrated.

A valve for spraying the steam line is preferably also provided.

The combustion chamber system 1 is preferably connected in series with a steam tube of an existing plant and is connected in series there by means of the flange.

For the manufacturing of the ceramic segments, a three-part mold concept is provided, in which the ceramic mass is inserted at the circumference. The aim here is to manufacture the two supporting surfaces close to their final contour and to as far as possible completely avoid finishing work.

The invention claimed is:

1. A combustion chamber system (1), comprising:

a flame tube (22) that defines a combustion chamber (30) therein in which hydrogen ($H_2$) and oxygen ($O_2$) are burned in the presence of water ($H_2O$) and/or water vapor (28, $H_2O$), an intermediate space (41) in which steam (28) flows around an outside of the flame tube and flows over an entire length of the flame tube (22), wherein the intermediate space (41) is closed at an end of the combustion chamber (30) in a region of an outlet opening (32) of the flame tube (22), wherein the flame tube (22) is annular or tubular in cross section, wherein the flame tube (22) comprises a plurality of modules (46', 46", . . . ) which are annular or tubular, wherein the modules (46', 46", . . . ) have steam passages (50) and/or the modules (46', 46" . . . ) have steam outlets (150) through which the steam flows into the combustion chamber (30);

wherein the steam passages (50) are angled at 80 to <90 degrees relative to a radial line of a combustion chamber (30) longitudinal axis (31) so as to prevent application of a hot flame to a wall of the flame tube (22); and wherein the steam passages (50) and/or the steam outlets (150) extend over the entire length and/or a circumference of the flame tube (22) or its modules (46', 46", . . . ).

2. The combustion chamber system (1) as claimed in claim 1, wherein except for one or more steam inlets and one or more steam outlets through the flame tube, the intermediate space (41) is a sealed space.

3. The combustion chamber system as claimed in claim 1, wherein a length of the combustion chamber (30) or the length of the flame tube (22) is three to five times a length of a hydraulic diameter of the combustion chamber (30) or of the flame tube (22), and/or wherein the combustion chamber (30), over the entire length, has a same cross section transversely with respect to a combustion chamber axis (31).

4. The combustion chamber as claimed in claim 1, wherein the modules (46', 46", . . . ) are arranged one above another coaxially, wherein the modules (46', 46", . . . ) are ceramic, and wherein the modules (46', 46", . . . ) are fastened to one another by groove (102) and tongue (101).

5. The combustion chamber system as claimed in claim 1, wherein the hydrogen ($H_2$) and the oxygen ($O_2$) and/or the water vapor flow into the combustion chamber (30) through a baseplate (4) and/or wherein the hydrogen ($H_2$) and the oxygen ($O_2$) and/or the water vapor are mixed in a mixer (55) located in the baseplate (4) and then flow into the combustion chamber (30).

6. The combustion chamber system as claimed in claim 1, further comprising:

an outer pressure jacket (40) which surrounds the combustion chamber (30) and thus forms the intermediate space (41), wherein the intermediate space (41) is directly bounded by the outer pressure jacket (40) and the flame tube (22), and wherein at the end of the combustion chamber (30) an upper plate (44) lies against the outer pressure jacket (40) and defines an end of the intermediate space (41).

7. The combustion chamber system as claimed in claim 1, further comprising:

a baseplate (4) through which the hydrogen ($H_2$) and the oxygen ($O_2$) flow into the combustion chamber (30), and a steam supply line (9) which conducts the steam (28) into the combustion chamber (30) and into the intermediate space (41), such that the steam flows from the baseplate in a direction of the outlet opening (32).

8. The combustion chamber system as claimed in claim 1, further comprising:

an igniter (405) which is guided into and out of the combustion chamber (30).

9. The combustion chamber system as claimed in claim 1, further comprising:

a baseplate (4) through which the hydrogen ($H_2$) and the oxygen ($O_2$) flow into the combustion chamber (30), drainage lines (33) and/or pressure control valves or overpressure protection (36) and/or a steam bypass (39) and/or an $H_2O$ spray (42) at the end of the combustion chamber (30), and/or a flushing system (3) which flushes through supply lines for the hydrogen ($H_2$), the oxygen ($O_2$) and/or the steam, and/or a flange (700) with the baseplate (4), with steam inlet openings (703, . . . ), with drainage openings for a drainage line (33) for removing condensates, and with an opening for a burner (58).

10. A method for generating steam using a combustion chamber system having a combustion chamber as claimed in claim 1, comprising:

burning the hydrogen ($H_2$) and the oxygen ($O_2$) in the combustion chamber (30), or introducing only the hydrogen ($H_2$), the oxygen ($O_2$), and also the water vapor into the combustion chamber (30).

11. The method as claimed in claim 10, wherein the steam (28) flows around the outside of the flame tube (22) in the intermediate space (41) and the steam flows in a direction of the outlet opening (32), as a result of which the flame tube (22) is cooled without further cooling, wherein all of the steam flows out of the intermediate space (41) into the combustion chamber (30), and wherein steam flows around a burner (58) during the burning.

12. The method as claimed in claim 10, wherein the hydrogen ($H_2$) and the oxygen ($O_2$) and/or the water vapor flow into the combustion chamber (30) through a baseplate (4), and wherein the hydrogen ($H_2$) and the oxygen ($O_2$) and also the water vapor flow into the combustion chamber (30) via the baseplate (4).

13. The method as claimed in claim 10, wherein the hydrogen ($H_2$) and the oxygen ($O_2$) and/or the water vapor flow into the combustion chamber (30) through a baseplate (4), and wherein the hydrogen ($H_2$) and the oxygen ($O_2$) and the water vapor are mixed in the baseplate (4) and flow into the combustion chamber (30) via the baseplate (4).

14. The method as claimed in claim 10, wherein the steam flows into the intermediate space (41) in order to keep the flame tube (22) warm or to heat the flame tube when not in operation.

15. The method as claimed in claim 10, wherein the combustion chamber (30) is operated in a steam atmosphere of 1 bar to 140 bar.

16. The method as claimed in claim 10, wherein the combustion chamber (30) is operated in a steam atmosphere of at least 2 bar.

17. The method as claimed in claim 10, wherein the combustion chamber (30) is operated at a pressure loss of 100 mbar-3000 mbar.

18. A plant comprising:

the combustion chamber system (1) as claimed in claim 1;

wherein the plant comprises a steam turbine plant or a gas and steam turbine plant or a plant for generating steam for process steam.

* * * * *